US010604323B2

(12) United States Patent
Sprick-Schuette

(10) Patent No.: US 10,604,323 B2
(45) Date of Patent: Mar. 31, 2020

(54) FAN-FOLDED PAPER WEB STACK

(71) Applicant: Sprick GmbH Bielefelder Papier- und Wellpappenwerke & Co., Bielefeld (DE)

(72) Inventor: Andreas Sprick-Schuette, Paderborn (DE)

(73) Assignee: Sprick GmbH Bielefelder Papier- und Wellpappenwerke & Co., Bielefeld (DE)

( * ) Notice: Subject to any disclaimer, the term of this patent is extended or adjusted under 35 U.S.C. 154(b) by 0 days.

(21) Appl. No.: 15/524,941

(22) PCT Filed: Oct. 27, 2015

(86) PCT No.: PCT/EP2015/002132
§ 371 (c)(1),
(2) Date: May 5, 2017

(87) PCT Pub. No.: WO2016/070970
PCT Pub. Date: May 12, 2016

(65) Prior Publication Data

US 2017/0313491 A1 Nov. 2, 2017

(30) Foreign Application Priority Data

Nov. 6, 2014 (DE) ..... 10 2014 016 372

(51) Int. Cl.
*B65D 81/05* (2006.01)
*D21H 11/14* (2006.01)
(Continued)

(52) U.S. Cl.
CPC ..... *B65D 81/05* (2013.01); *B42D 15/00* (2013.01); *B65H 45/20* (2013.01); *D21H 11/14* (2013.01); *Y10T 428/15* (2015.01)

(58) Field of Classification Search
CPC .... Y10T 428/15; B65H 45/20; B65H 45/228; B65D 81/05
See application file for complete search history.

(56) References Cited

U.S. PATENT DOCUMENTS 4,735,437 A 4/1988 Fattibene
4,745,835 A 5/1988 Schnitzer
(Continued)

FOREIGN PATENT DOCUMENTS

DE 60223534 T2 9/2008
EP 1345757 B1 8/2006
(Continued)

OTHER PUBLICATIONS

International Search Report dated Nov. 6, 2014.

*Primary Examiner* — Alexander S Thomas
(74) *Attorney, Agent, or Firm* — Schiff Hardin LLP

(57) ABSTRACT

In a zig-zag folded stack of paper web, particularly a stack of recycling paper web, wherein at least one fold of the zag folded stack of paper web is provided with a perforation-tie-row, wherein the ties of the fold coupled to folding-web-she folded above one another, wherein the fold tie in the perforation, each, comprise a maximal longitudinal direction [respective] in the longitudinal fold direction, it is provided that at least one section of a fold comprises a perforation-fold-row of at least five alternatingly arranged ties and perforations, wherein a ratio of a summed up combined longitudinal extension of the folding ties within the section in relation to a summed up combined longitudinal extension of the perforations of the same number within the folding section is larger than or equal to 0.8, preferably larger than or equal to 1.

17 Claims, 3 Drawing Sheets

(51) Int. Cl.
*B42D 15/00* (2006.01)
*B65H 45/20* (2006.01)

(56) References Cited

U.S. PATENT DOCUMENTS

| | | | | |
|---|---|---|---|---|
| 6,146,731 | A * | 11/2000 | Tanoto | B32B 7/04 428/43 |
| 6,548,136 | B1 | 4/2003 | Piccini et al. | |
| 2010/0160132 | A1* | 6/2010 | Cheich | B31D 5/0047 493/340 |

FOREIGN PATENT DOCUMENTS

| | | | |
|---|---|---|---|
| WO | 2005/061357 | A1 | 7/2005 |
| WO | 2013/115687 | A1 | 8/2013 |

* cited by examiner

FAN-FOLDED PAPER WEB STACK

BACKGROUND

The invention relates to a zig-zag folded web of paper material in particular for further processing as dunnage material or cushioning material for example by means of a dunnage material machine which mechanically forms a folded paper web into a dunnage material, such as a cushioning material, particularly without adding any further materials to the paper web.

One example for a zig-zag folded stack of paper web for producing the dunnage material stack and a dunnage material machine suitable therefore are known from EP 1 345 757 B1, wherein reference is particularly made to FIG. 3 of EP 1 345 757 B1 which shows the zig-zag folded stack of paper web.

In order to increase the stacking height and the folding capability of the paper web, it is known to perforate the folds of the stack of paper web whereby the web of material is weakened in order to predetermine the run of the fold(s) of the web paper material in an accurately positioned manner, to decrease the space of the fold(s) and in order to enable the later tearing off of the material web having been formed into a dunnage material.

It is known to form the folds of the zig-zag folded stack of paper web with a perforation-tie-row or row of perforations and ties. One example for a known perforated fold shall be schematically illustrated with the attached FIG. 1. The perforation-tie-row (e) is continuously formed with a tie-width and perforation-width remaining constant along the entire longitudinal extension in the longitudinal direction of the fold q lying parallel to the crosswise direction of the paper web. The ratio perforation-width to tie-width lies at 2:1 or 3:1 in favor of a larger perforation-width. It is known that the fold-tie (b), i.e. the bridge comprises its maximal longitudinal extension ($x_f$) along the fold (a) in the longitudinal fold direction (q) of at most 1 mm. The perforation (c), that is the oblong or an elongated hole or through hole, is formed in the paper web with a maximal longitudinal extension (y') of 2 mm to 3 mm.

It has been shown that, in particular when utilizing a folded stack of paper web made of short-fiber paper material, when unfolding and during feeding conveyance into the dunnage machine, the paper web tears apart along the weakened fold or crease so that the automized production process for dunnage material is disturbed. Most of all when increasing the feeding velocity of the paper web into the dunnage material machine, the unfolding forces increase so much that an unfolding of the stack of paper web free of tearing can no longer be ensured with sufficient reliability.

It is an objective of the invention to overcome the disadvantages of the prior art, particularly to provide a zig-zag folded for fan-folded stack of paper web particularly made of recycling paper, preferably on the basis of 100% used paper, wherein on one hand folding in a positionally predefined and space-saving manner is simplified, and on the other hand unintentional tearing apart of the paper web particularly during machine-processing into dunnage material it is avoided, wherein in particular a simple, positionally accurate tearing of the dunnage material made from the stack of paper web is simplified.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
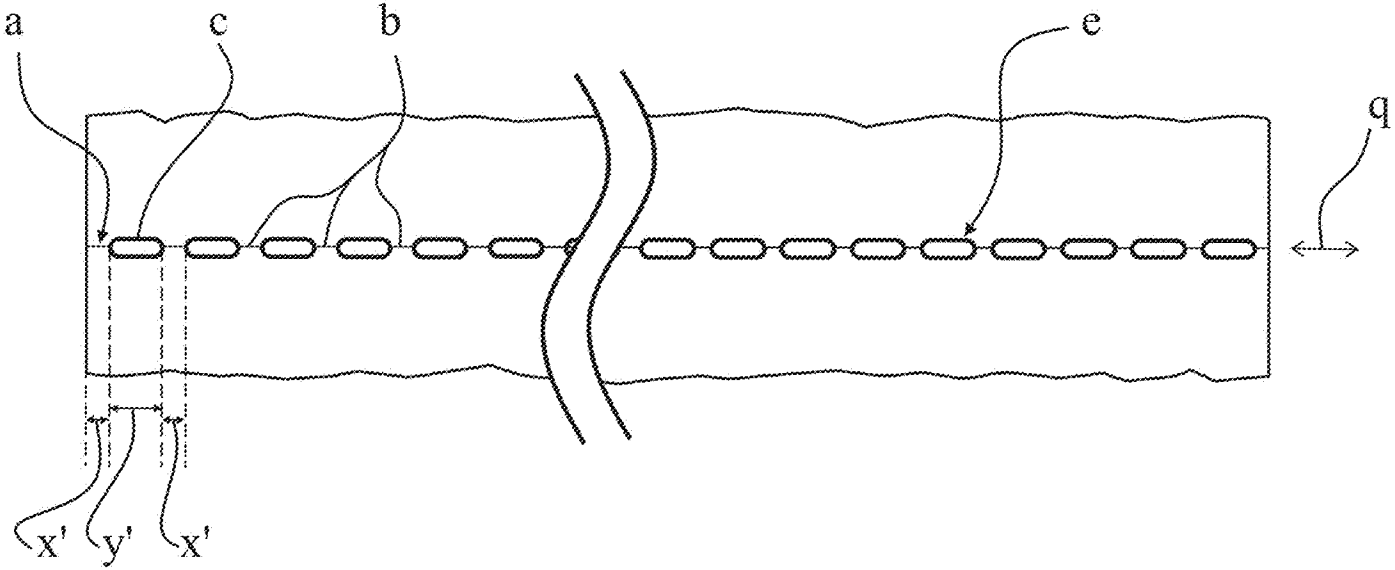
FIG. 1 illustrates an example of a perforated fold.

The exemplary embodiments of the present disclosure will be described with reference to the accompanying drawings.

DETAILED DESCRIPTION

In the following description, numerous specific details are set forth in order to provide a thorough understanding of the embodiments of the present disclosure.

According to the invention, a zig-zag folded stack of paper web, particularly a stack of paper web made of recycling paper for example on the basis of 70% to 100% used paper, is provided, for the purpose of being further processed into packaging or dunnage material. The at least one fold of the zig-zag folded stack of paper web is formed with a perforation-tie-row or row of perforations and ties. Preferably, the predominant part of the fold or crease, in particular the entire run of the fold, is formed with a perforation-tie-row. In a preferred embodiment of the invention, all folds of the zig-zag folded stack of paper web are provided with the perforation-tie-row. Fold-ties or bridges of the fold of the stack of paper web couple two sheets of the stack of the paper web folded above one another to one another and serve as a folding hinge in order to realize the accurately positioned, aligned lying on top of each other of the folding sheets of the stack. The more accurately positioned the folding by means of the ties is achieved, the more space-saving the stack of paper web according to the invention can be realized. The tie and the perforation of the perforation-tie-row each have an individual maximal longitudinal extension (perforation-tie-individual maximal width) in the longitudinal fold direction (particularly across from the longitudinal paper web-direction). The perforation of the perforation-tie-row shall preferably be of oblong or elongated shape, wherein preferably the hole-edges in the longitudinal fold direction are rounded and the longitudinal sides of the oblong hole parallel to one another. In a special embodiment, the perforation can also have a nearly circular hole edge shape. In a preferred embodiment of the invention, it is possible that small notches or small lacerations can be arranged on the edges of the perforation, having an influence to the tearing resistance of the paper web particularly at the perforation-tie-row or weakened fold line. The fold ties are realized uniform with the sheets of the folding web coupled thereto and are limited in the longitudinal fold direction by the two adjacent perforations, unless the respective tie forms the longitudinal edge of the paper web. In this case only one perforation is adjacent to the edge-tie. Preferably, the longitudinal edges of the paper web are realized continuously free of perforations and rectilinear and are realized by the edge fold-tie on the web-height of the fold. The longitudinal extension of the folding tie and/or the longitudinal extension of the perforation can vary or remain constant along the run of the perforation-fold row, wherein in particular the longitudinal tie extension can be as large as the longitudinal perforation extension. At least one section of the fold comprises a strengthened for reinforced perforation-tie-row of at least 5 or 10 alternatingly arranged ties and perforations. One fold section can realize an entire fold or multiple fold sections can extend along one fold. All folds of the stack of paper web can be realized correspondingly. According to the invention, a ratio of a combined longitudinal extension of the summed up maximal individual longitudinal extensions of the fold ties within the considered fold section in relation to the combined longitudinal extension of the summed up maximal individual longitudinal extensions of the perforations of the same number (as the ties) within the fold section defined above is larger than or equal to 0.8, preferably larger than or equal to 1 or 1.5.

In a preferred embodiment of the invention, the combined longitudinal extension ratio is smaller than 3 or smaller than 4 or smaller than 5.

Preferably, the combined longitudinal extension ratio lies between 1 and 2.5.

In a further development of the invention, the fold section of at least five ties is arranged close to the lateral edge of the paper web or is arranged in a central area of the paper web. The reinforced central area of the paper web can then be deformed, particularly embossed, by a tool, such as embossing wheels, of a dunnage material machine.

In a further development of the invention, the fold section extends over the entire longitudinal extension of the paper web. Alternatively, at least one further differently designed fold section can be attached, which in particular in relation to the first fold section has a different combined longitudinal extension ratio being larger than or equal to 0.8, preferably larger to or equal to 1 (1.5).

In a preferred embodiment of the invention, the longitudinal extension of the ties and/or of the perforations within the fold section or equal the large. Alternatively or additionally, the longitudinal extension of the tie can be at least as large as or larger than that of the perforation, particularly approximately at least twice as large.

According to an alternative aspect of the invention, a zig-zag folded stack of paper web is provided, which can in particular be also combined with the inventive details of the above-mentioned aspect of the invention. At least one fold or crease, preferably all folds, of the zig-zag folded stack of paper web is (are) formed with a perforation-tie-row, wherein ties of the fold coupled to sheets of the folding web being folded above one another. The tie has its maximal longitudinal extension along the longitudinal direction of the fold. The ties of the perforation-tie-row can be of different size, wherein one perforation or the perforation which exceptionally is larger than the adjacent tie, is connected to the tie in the longitudinal fold direction. According to the invention, at least one tie is larger than 1.5 mm, preferably larger than 2 mm or 3 mm. In particular in case of ties of larger dimensions of above 2 mm particularly on the edge on the end edge of the paper web, some perforations (less than 10%) can be larger than a part of the other paper ties (less than 2 mm) in the course or run of the fold.

In a further development of the invention, the fold end tie ends, due to its longitudinal extension of more than 1.5 mm, in the left lateral end edge of the paper web which in particular runs rectilinear in the course of the paper web. Alternatively or additionally a folding tie can be arranged in a central area of the paper web with may also be larger than 1.5 mm.

In a further development of the invention, at least 1/5 fold ties of the fold are larger than 1.5 mm, preferably larger than 2 mm or 3 mm. In particular, at least half of the ties of one fold, at least 75%, preferably at least 90% or essentially all ties of the fold, are larger than 1.5 mm, preferably larger than 2 mm or larger than 3.

In a further aspect according to the invention, which can also be combined with any of the above-mentioned aspects of the invention, a zig-zig of fold stack of paper web is provided, wherein at least one fold of the zig-zag fold stack of paper web is formed with a perforation-tie-row. Ties of the fold hold two sheets folded above one another together. The ties and the perforations of the fold each comprise a maximal longitudinal extension in their respective longitudinal fold direction. The ties and the perforations preferably have a constant maximal longitudinal extension, however, may vary. According to one section of the stack-fold, each one of the perforation-tie-rows has at least five or ten alternatingly arranged ties and perforations, respectively. The single longitudinal extension of each tie within the fold section is at least as large as or larger than or twice as large as the single longitudinal extension of the perforation within said section.

In a preferred embodiment of the invention, the paper ties and/or perforations each have a longitudinal extension remaining constant along the entire fold.

Figure 2:
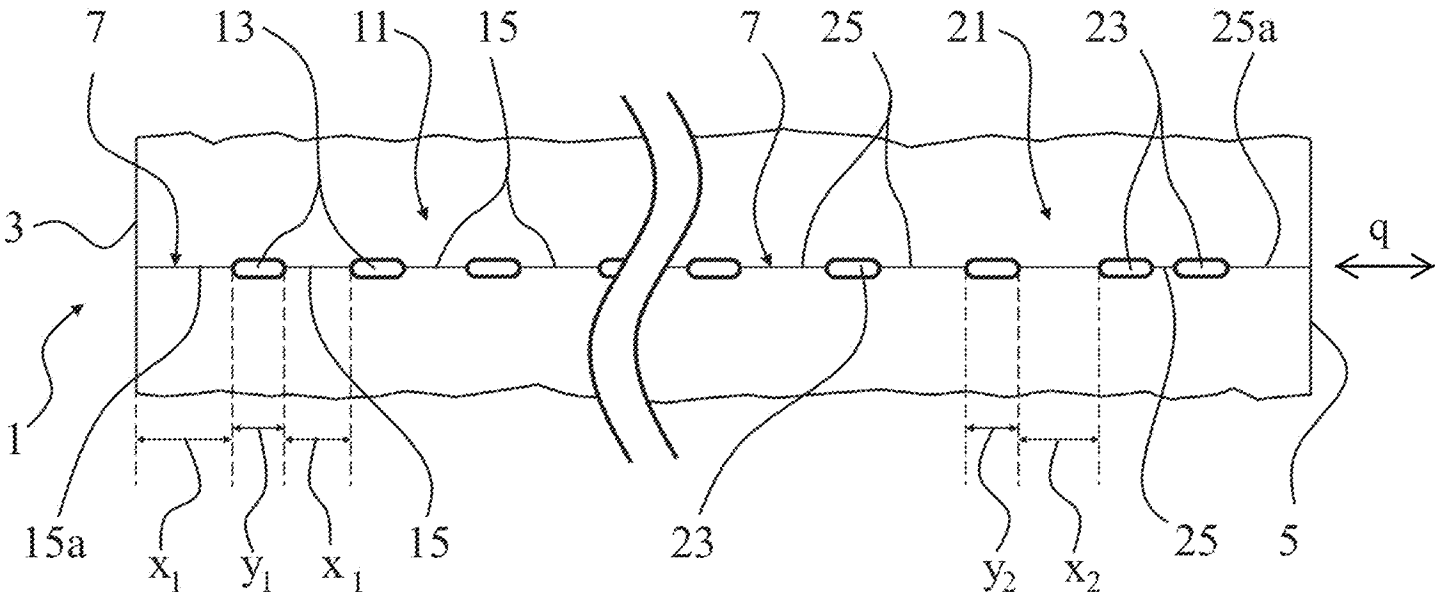
FIG. 2 is a schematic view onto a section of a zig-zag folded stack of paper web in the area of the perforated fold having multiple perforation-tie-rows.
Figure 3:
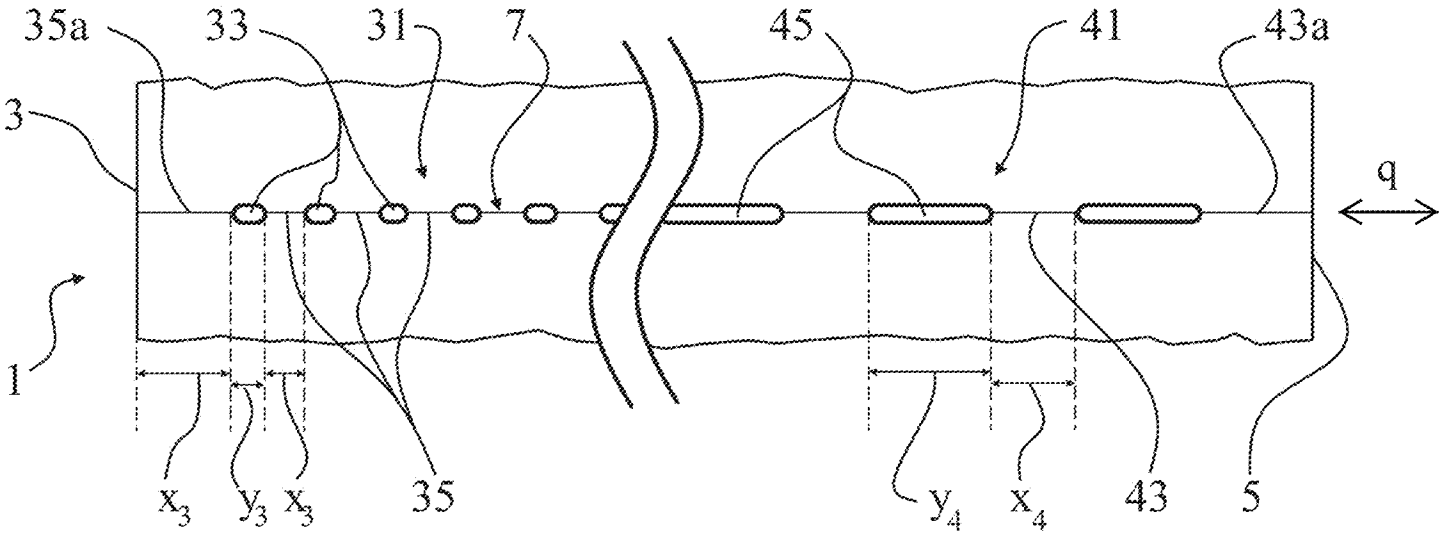
FIG. 3 is an embodiment of the perforated fold of a stack of paper web with multiple perforation-tie-rows.

In FIG. 2 merely one section of the zig-zag folded stack of paper web according to the invention is shown, generally with the reference numeral 1, wherein the complete stack of paper web is illustrated in FIG. 3 of the above-mentioned patent EP 1 345 757 B1. This FIG. 3 shall completely be incorporated by reference into this description. The section of a stack of paper web shown in FIG. 2 has 2 parallel longitudinal edges 3, 5 lying opposite one another forming the wide surfaces of the rectangular block-stack of paper web. Essentially perpendicular to the longitudinal edges 3, 5, a fold 7 of the zig-zag folded stack of paper web extends. Through two parallel sinuous crossing the fold 7, it shall be illustrated that not the entire width of the paper web in the longitudinal fold direction q is illustrated but, for reasons of the simple schematic illustration, several perforation-tie-rows 11, 21 of different embodiments along the longitudinal fold direction q are represented as detailed areas of the perforated fold 7. The perforation-tie-rows are illustrated in a supersized manner.

In a first configuration of the perforation-tie-row 11 three perforations 13 attached to the lateral edge 3 are provided.

The perforation-tie-row 11 according to FIG. 2 shows the four fold ties 15 which is shown may be of different length or of the same length. In the embodiment of the perforation-tie-row 11 illustrated in FIG. 2, an edge-tie 15 *a* is provided having a length in the longitudinal fold direction q larger than 1 mm, wherein in the example of the edge fold tie 58 shown in FIG. 2, a longitudinal extension $x_1$ is of 2 mm or 2.5 mm.

The further paper ties 15 attached in the longitudinal fold direction q to the edge fold tie 15*a* can have a longitudinal extension $x_2$ remaining constant, of about 1 mm or 1.5 mm, wherein also the changing longitudinal extension for the three ties 15 can be provided. It is particular to the perforation-tie-row 11 shown in FIG. 2 that the perforation 13 (three of which are shown, wherein also five to ten perforations for the perforation-tie-row 11 arranged at the edge section of the paper web can be provided) comprise a longitudinal extension y remaining constant. The longitudinal extension y measures for the perforations 13.1 mm or 1.5 mm, wherein, according to the invention, at least a sectionally it shall be minded that, for a point of view of the perforation-tie-a row of at least five alternatingly immediately succeedingly arranged fold ties 15/perforations 13 in one row, a ratio of combined respective longitudinal extension of the summed individual longitudinal extensions is no smaller than 0.8, preferably larger than or equal to 1 or 1.5.

For this, the following equation shall apply for a combined longitudinal extension ratio in relation to the ties and perforations immediately adjacently connected to one another of the perforation-tie-row (wherein n designates the equally large number of fold ties and perforations):

$$\sum_{i=1}^{n} \frac{x_i}{y_1} \geq 0.8 \; oder \geq 1 \; oder \geq 1.5$$

i=running tie-/perforation-number along a fold section, in particular along the entire fold preferably in relation to all folds of the paper web.

Especially for the embodiment shown in FIG. 2, the relatively wide dimensioning of the border edge fold tie 15*a* is visible. It has been shown, that when the feeding and/or deforming the stack of paper web which is to be unfolded, especially in the edge sections, large tensile forces act. A particularly wide folding tie 15*a* reduces the likelihood significantly that the stack of paper web will be damaged during unfolding and during introducing in its unfolded state into the dunnage machine at this neuralgic spot. In succession to the border tie 15*a*, ties 15 of smaller dimension can be provided so that the longitudinal extension ratio decreases (however, above the above defined minimum requirements), so that the space-saving foldability of the zig-zag folded stack of paper web is simplified.

At further neuralgic sections of the stack of paper web, which are subjected to high operational load forces, particularly when unfolding and when feeding and when processing in a packaging material machine (for example according to EP 1 345 757), folding ties or bridges are to be provided being a larger than 1.5 mm, preferably larger than 2 mm or 3 mm. One example for such a neuralgic section is the center of the paper web which may be deformed using embossing wheels for providing a soft cushioning characteristics for the dunnage material. In such a an area, a perforation-tie-row 21 can be provided, which, as shown in FIG. 2, lies in the central area of the illustrated section 1 of a stack of paper web. The illustrated perforation-tie-row 21 is at least 1, 2 or 3 (particularly at least five) ties 25 which have a longitudinal extension $x_2$ of 2.5 mm to 3 mm, wherein in the perforations 23 adjacent thereto have a longitudinal extension $y_2$21 of approximately 1 mm or 1.5 mm.

The perforation-tie-row can comprise at least five respective paper ties/perforations immediately succeeding one another in accordance with the perforation-tie-row 11 to 81 being shown in the FIGS. 2-5, respectively. It shall be clear that the longitudinal extension $x_i$ of n folding ties can be varied, be at least as large as, or up to twice as just the smallest or preferably largest longitudinal extension $y_i$ of the n perforations.

It shall be clear that also the longitudinal extension $y_i$ of the perforations can vary. Preferably, however, at that neuralgic spots of the fold (deformed central area, edge section) the longitudinal extension $y_i$ of the perforations shall be smaller than the longitudinal extension $x_y$ of the ties or bridges 15.

In FIG. 2 a paper tie 25*a* is provided adjacent to the longitudinal edge 5 ending in the lateral edge 5. The dimension of the tie 25*a* in the longitudinal fold direction q is larger than, particularly twice as large as, the perforation 23 adjacent thereto.

In FIG. 3, two different perforation-tie rows are designated with the reference numerals 31 and 41. The perforation-tie-row 31 differs from that of FIG. 2 in that, for the edge fold tie 35*a*, smaller absolute longitudinal extension $x_{31}$ is used. Rather, the longitudinal extension $x_3$ of the fold tie 35 in the longitudinal fold direction q within the perforation-tie-row 31 is essentially equally large, wherein, for the maximal longitudinal extension $x_3$, a width of 1.5 mm or 1 m is considered. Particularly for the perforation-tie-row 31 the maximal longitudinal extension $y_{31}$ of the perforations 33 remaining constant is smaller than the ties 35 are and is particularly smaller than 1 mm, preferably being about 0.5 mm strong. In the perforation-tie-row 31, the border edge tie 35*a* is equally large as the succeeding ties 35, however, the border edge tie 35*a* is significantly larger than the perforation 53 attached thereto.

In the fold perforation-tie-row 41 at the right section of the stack one of paper web, significantly larger perforations 45 are inserted into the paper web, which may have a maximal longitudinal extension $y_4$ of above 2 mm, preferably 3 mm to 4 mm. It shall be clear that the ties 43 (43*a*) lying there between may be as large as or larger than the perforations 45 in the perforation-tie-row 41 and it may even be that some ties 43 are slightly smaller than the perforations 45. Particularly in case of paper ties 43 larger than 1.5 mm and 2 mm, the perforations 45 may be larger than the paper ties 43. The border tie 43*a* should, however, in case of a selection of relatively large perforations, be of at least the same size relative to the adjacent perforation 45.

Figure 4:
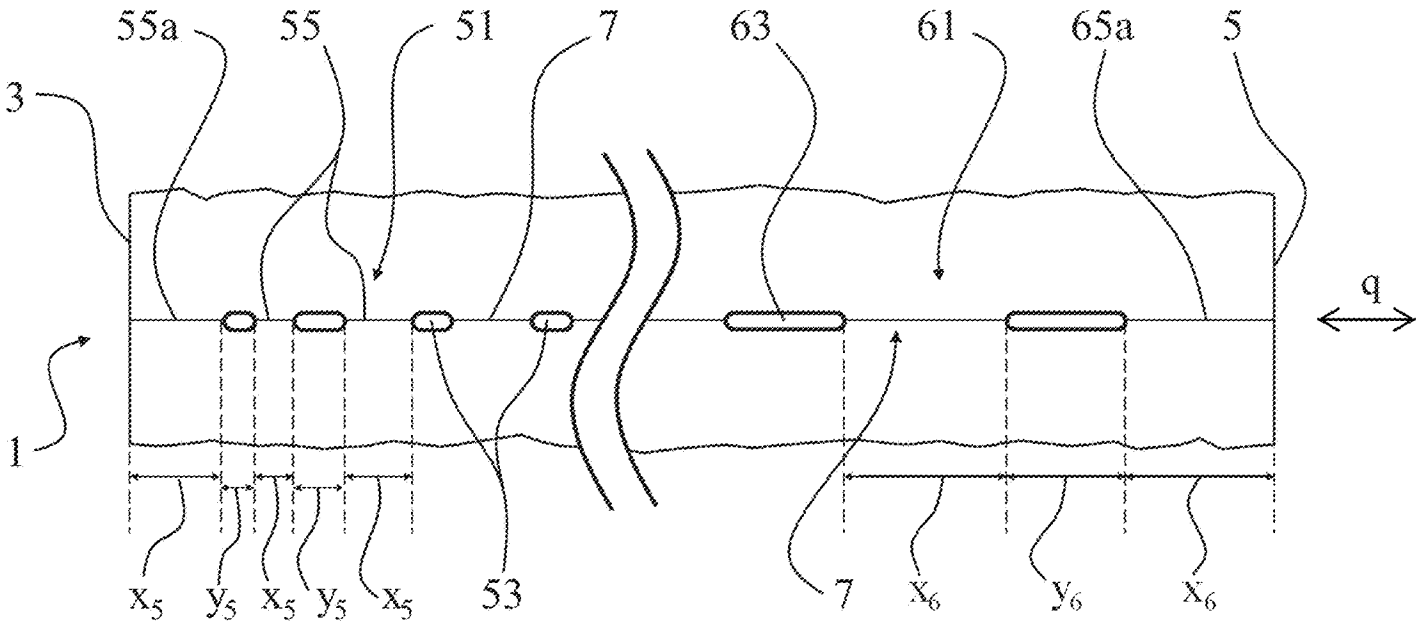
FIG. 4 is an embodiment of the perforated fold of a stack of paper web according to the invention having multiple perforation-tie-rows.

In the section one of the stack of paper web according to FIG. 4, also to perforation-tie-rows 51, 61 are illustrated in which the perforation-tie-row 51 shows four perforations 53 of in part different longitudinal extension $y_5$ and fivefold the ties of different longitudinal extension $x_5$. It is shown that the longitudinal extension ratio of the fold ties 55 (55*a*) relative to the perforations 53 is larger than 1. In particular the always different selection of longitudinal extensions $x_5$ for the ties 55 (55*a*) is visible for the embodiment of the perforation-tie-row 51, wherein the longitudinal extensions $x_5$, lie between 1.5 mm and 4 mm.

It is particular to the embodiment of the perforation-tie-row 51 according to FIG. 4, that one tie 55 distal to the longitudinal lateral edge 3 is larger than the other fold tie 55*a* which is selected to be larger in other instances. This constellation can be provided particularly whenever the border tie 55*a* is a selected with a dimension of larger than 3 mm. In a succession, fold ties 55 of larger extension can be provided for more stable foldability which may alternate with smaller ties.

At the second perforation-tie-row 61 according to FIG. 4, a particularly stable and tearing resistant paper web is provided, for which the border edge tie 65*a* adjacent to the lateral edge 5 is dimensioned significantly larger than 3 mm, preferably above 4 mm. Adjacent thereto a small perforation 63 of the dimension of about 2 mm can be attached.

Figure 5:
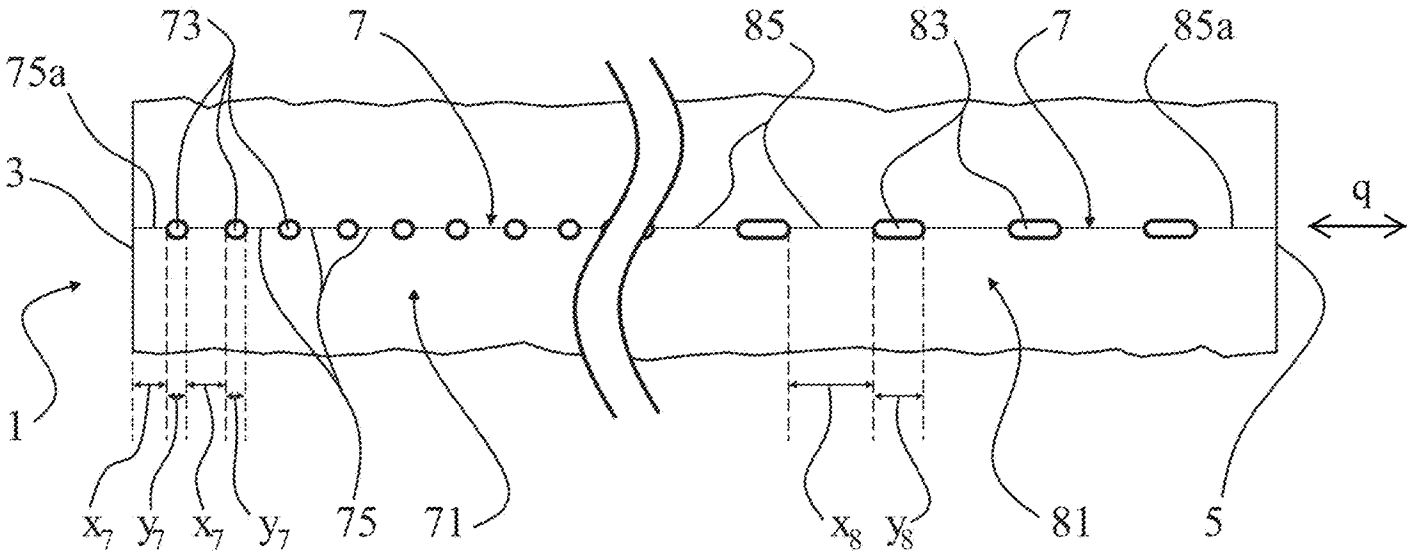
FIG. 5 is an embodiment of a fold perforated according to the invention of a stack of paper web having multiple perforation-tie-rows.

In FIG. 5 the section one of the stack of paper web is provided with, again, two perforation-tie-rows 71, 81, wherein the two perforation-tie-rows 71, 81 are particularly tear resistant.

The perforation-tie-row 70 has folding ties 75 (75*a*) which are of equal size and formed to be 1 mm or smaller than 1 mm, wherein the constant longitudinal extension $y_7$ of the perforations 73 is smaller by half than the longitudinal extension $x_7$ of the ties 75 (75*a*). The longitudinal extension $y_7$ of the folding ties lies at of approximately 0.8 mm to 1 mm while the maximal longitudinal extension $y_7$ of the perforation 73 lies at 0.5 mm or below.

The combined longitudinal extension ratio between folding tie and perforations lies significantly above 1.5 in this perforation-tie-row.

In the further perforation-tie-row 81 according to FIG. 5, the ties 85 remain of the same size along the longitudinal fold direction q and lie at about 1.5 mm to 2 mm. The perforations 83 remain dimensioned of the same size and lie at a significantly below 1 mm. The maximal longitudinal extension $y_8$ can vary along the course of the perforation-tie-row 81.

In the perforation-tie-rows 11 to 81 shown in FIGS. 2-5, for reasons of illustration, less than 5 alternatingly arranged ties and perforations in a row are illustrated, however, for the calculation of the combined longitudinal extension of the fold ties or perforation at least 5 perforations/ties shall be connected to one another in a row. In the illustrated perforation-tie-rows 11 to 81, the respective sequence(s) of perforations and ties shall be continued in order to obtain a minimum number of 5 is and perforations.

The features described in the above description, the figures and the claims can be of importance for the realization of the invention in the different embodiments, both individually as well as in any combination thereof.

LIST OF REFERENCE NUMERALS

1 stack of paper
3, 5 longitudinal edge
7, *a* fold
11, 21, 31, 41, 51, 61, 71, 81, *e* perforation-tie-row
13, 23, 33, 43, 53, 63, 73, 83, *c* perforation
15, 25, 35, 45, 55, 65, 75, 85, *b* tie
15*a*, 25*a*, 35*a*, 45*a*, 55*a*, 65*a*, 75*a*, 85*a* edge tie
q fold direction
$x'$,$x_i$, $x_y$, $x_1$, $x_2$, $x_3$, $x_4$, $x_5$, $x_6$, $x_7$, $x_8$ longitudinal extension
$y'$,$y_i$, $y_1$, $y_2$, $y_3$, $y_4$, $y_5$, $y_6$, $y_7$, $y_8$ longitudinal extension

The invention claimed is:

1. A zig-zag folded stack of paper web, comprising:

at least one fold of the zig-zag folded stack of paper web formed with a perforation-tie-row including a fold section, wherein the zig-zag folded stack of paper web is configured to be processed as dunnage material or cushioning material by a dunnage material machine;

ties of the perforation-tie-row of the at least one fold are configured to couple two sheets of paper folded above one another together, each of the ties comprising a longitudinal extension in a longitudinal fold direction; and perforations of the perforation-tie-row of the at least one fold, each of the perforations comprising a longitudinal extension in the longitudinal fold direction, wherein:

each of the perforations of the perforation-tie-row include one or more notches or lacerations arranged on respective edges of each of the perforations, the one or more notches or lacerations being configured to influence a tearing resistance of the paper web at the perforation-tie-row, the fold section includes at least five ties and perforations alternatingly arranged, and the fold section has a ratio of a summed combined longitudinal extension of the individual longitudinal extensions of the ties within said fold section with respect to a summed combined longitudinal extension of the individual longitudinal extensions of the perforations of a same number within said fold section is larger than or equal to 0.8.

2. The zig-zag folded stack of paper web according to claim 1, wherein the ratio is smaller than 3 or 4.

3. The zig-zag folded stack of paper web according to claim 1, wherein the fold section ends in a lateral edge of the paper web.

4. The zig-zag folded stack of paper web according to claim 3, wherein the fold section is rectilinear along the run of the paper web or is arranged in a central area of the paper web.

5. The zig-zag folded stack of paper web according to claim 1, wherein:

the fold section extends across the entire longitudinal extension of the paper web; or a second fold section different from and connected to the fold section has a second ratio of a summed combined longitudinal extension of the individual longitudinal extensions of the ties within said second fold section with respect to a summed combined longitudinal extension of the individual longitudinal extensions of the perforations of a same number within said second fold section is larger than or equal to 1.

6. The zig-zag folded stack of paper web according to claim 5, wherein the individual longitudinal extensions of each tie of the ties within the second fold section are at least as large as, or larger than, or twice as large as the individual longitudinal extensions of each perforation of the perforations within said second fold section.

7. The zig-zag folded stack of paper web according to claim 1, wherein:

the respective longitudinal extensions of the ties within the fold section are the same and/or the respective longitudinal extensions of the perforations within the fold section are the same.

8. The zig-zag folded stack of paper web according to claim 1, wherein:

perforations connect to adjacent ones of the ties in the longitudinal fold direction, and at least one tie of the ties is larger than 1.5 mm.

9. The zig-zag folded stack of paper web according to claim 8, wherein the at least one tie of the ties ends in a lateral edge of the paper web or is arranged in a central area of the paper web.

10. The zig-zag folded stack of paper web according to claim 8, wherein:

at least one-fifth of all ties of the fold of the paper web are larger than 1.5 mm, 2 mm or 3 mm, or at least half of the ties of the fold or all of the ties of the fold are larger than 1.5 mm, 2 mm or 3 mm.

11. The zig-zag folded stack of paper web according to claim 8, wherein the least one tie of the ties is larger than 2 or 5 mm.

12. The zig-zag folded stack of paper web according to claim 1, wherein the individual longitudinal extensions of each tie of the ties within the fold section are at least as large as, or larger than, or twice as large as the individual longitudinal extensions of each perforation of the perforations within said fold section.

13. The zig-zag folded stack of paper web according to claim 1, wherein the respective longitudinal extensions of the ties and the perforations remain constant along the fold.

14. The zig-zag folded stack of paper web according to claim 1, wherein the zig-zag folded stack of paper web is a recycled paper web.

15. The zig-zag folded stack of paper web according to claim 1, wherein the ratio is larger than or equal to 1.

16. The zig-zag folded stack of paper web according to claim 1, wherein the ties are twice as large as that of the perforations in the longitudinal direction.

17. The zig-zag folded stack of paper web according to claim 1, wherein the perforation-tie-row forms a folding hinge that includes the fold section and is configured to: couple the two sheets of paper of the zig-zag folded stack of paper web together, and position and align the two sheets of paper folded above one another within the zig-zag folded stack to increase a space savings within the zig-zag folded stack.

* * * * *